US005702175A

United States Patent [19]

Chen

[11] Patent Number: 5,702,175

[45] Date of Patent: Dec. 30, 1997

[54] MOVABLE LAMP DEVICE

[76] Inventor: Jenn-Hwang Chen, 58, Ma Yuan West St., Taichung, Taiwan

[21] Appl. No.: 679,790

[22] Filed: Jul. 15, 1996

[51] Int. Cl.[6] ..... F21L 15/20

[52] U.S. Cl. ..... 362/191; 362/184; 362/198; 362/396; 362/419

[58] Field of Search ..... 362/184, 197–199, 362/190, 191, 285, 396, 413, 414, 418, 419; 248/160, 276

[56] References Cited

U.S. PATENT DOCUMENTS

| | | | |
|---|---|---|---|
| 1,606,219 | 11/1926 | Havens | 362/396 |
| 1,832,443 | 11/1931 | Barany | 362/197 |
| 5,101,333 | 3/1992 | Glassford | 362/413 |
| 5,103,384 | 4/1992 | Drohan | 362/191 |
| 5,276,596 | 1/1994 | Krenzel | 362/191 |
| 5,414,608 | 5/1995 | Stekelenburg | 362/396 |
| 5,517,392 | 5/1996 | Rousso et al. | 362/198 |

*Primary Examiner*—Alan Cariaso

[57] ABSTRACT

A movable lamp device has a clamp device, a lamp casing, and a flexible tube connecting the clamp device and the lamp casing. The clamp device has a first clamp and a second clamp disposed under the first clamp. The first clamp and the second clamp are fastened pivotally. The lamp casing has a first half housing and a second half housing coupling with the first half housing. A main lamp is disposed in a front of the lamp casing. A flash lamp and a cell chamber are disposed on a first side of the lamp casing. A hook device is disposed on a second side of the lamp casing. A cell cover covers the cell chamber. A switch is disposed on a top portion of the lamp casing. A threaded recess hole is formed in a rear portion of the lamp casing to receive a second end of the flexible tube. A threaded through hole is formed on the first clamp to receive a first end of the flexible tube.

1 Claim, 5 Drawing Sheets

MOVABLE LAMP DEVICE

BACKGROUND OF THE INVENTION

The invention relates to a movable lamp device. More particularly, the invention relates to a movable lamp device which has a main lamp and a flash lamp.

Most conventional flashlights should be held by the user. Since one hand of the user should hold the flashlight, the user cannot use two hands manually at the same time.

SUMMARY OF THE INVENTION

An object of the invention is to provide a movable lamp device which can be positioned on a fixed article.

Another object of the invention is to provide a movable lamp device which can be wound on an arm of a user.

Another object of the invention is to provide a movable lamp device which can be positioned on a belt of a user.

Accordingly, a movable lamp device has a clamp device, a lamp casing, and a flexible tube connecting the clamp device and the lamp casing. The clamp device has a first clamp and a second clamp disposed under the first clamp. The first clamp and the second clamp are fastened pivotally. A threaded through hole is formed on the first clamp. Two lower lobes are disposed on two opposite sides of the first clamp. An upper clamp portion is disposed in a front of the first clamp. Two lower clips are disposed beneath the upper clamp portion of the first clamp. Two upper lobes are disposed on two opposite sides of the second clamp. A lower clamp portion is disposed in a front of the second clamp. Two upper clips are disposed on the lower clamp portion of the second clamp. A torsion spring is disposed between two upper lobes. A pin passes through the lower lobes, the torsion spring and the upper lobes. The lamp casing has a first half housing and a second half housing coupling with the first half housing. A main lamp is disposed in a front of the lamp casing. A flash lamp and a cell chamber are disposed on a first side of the lamp casing. A hook device is disposed on a second side of the lamp casing. A cell cover covers the cell chamber. A switch is disposed on a top portion of the lamp casing. A threaded recess hole is formed in a rear portion of the lamp casing. A first threaded post is disposed on a first end of the flexible tube. A second threaded post is disposed on a second end of the flexible tube. The first threaded post is inserted in the threaded through hole. The second threaded post is inserted in the threaded recess hole.

DETAILED DESCRIPTION OF THE INVENTION

Figure 1:
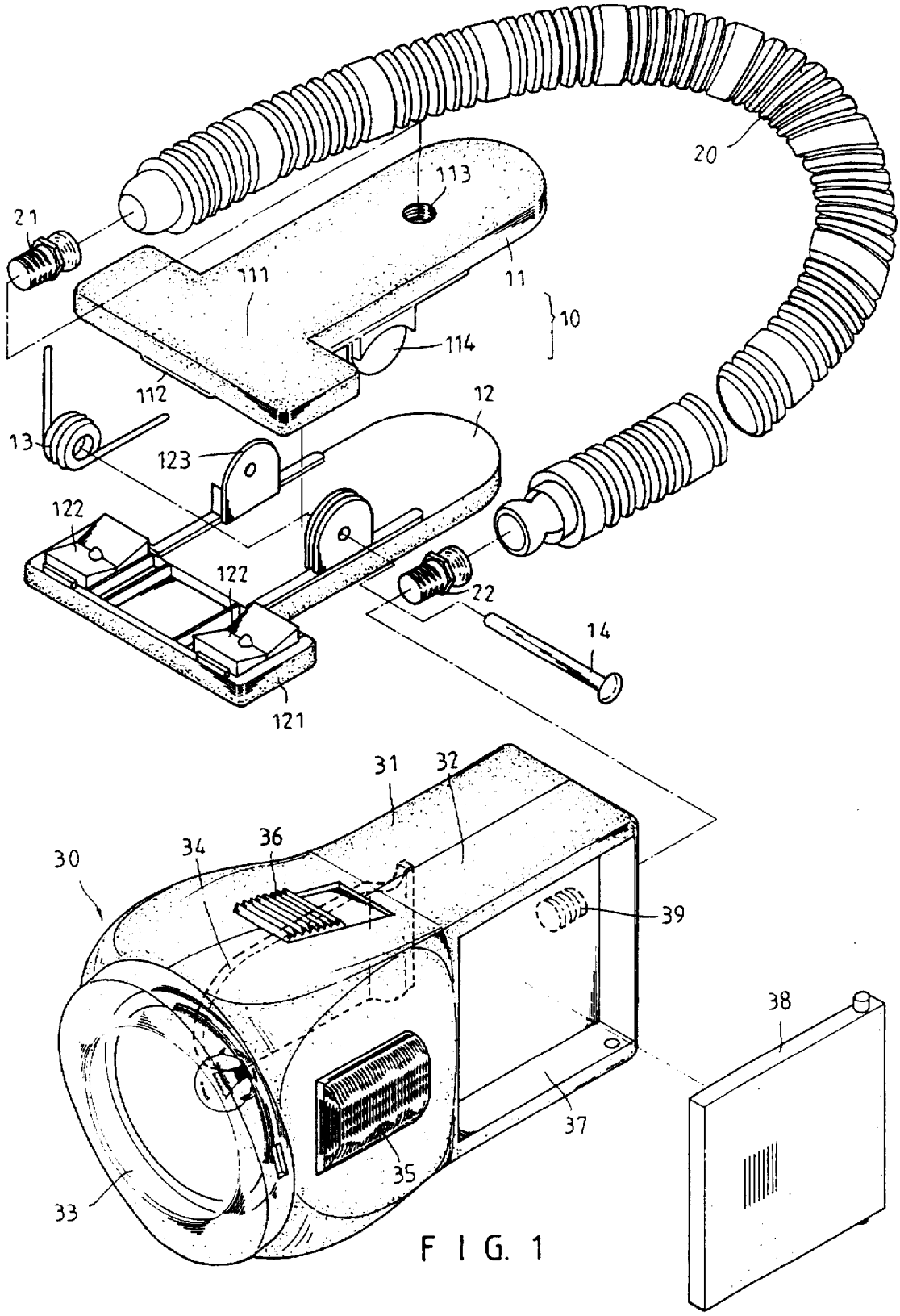
FIG. 1 is a perspective exploded view of a movable lamp device of a preferred embodiment in accordance with the invention.
Figure 5:
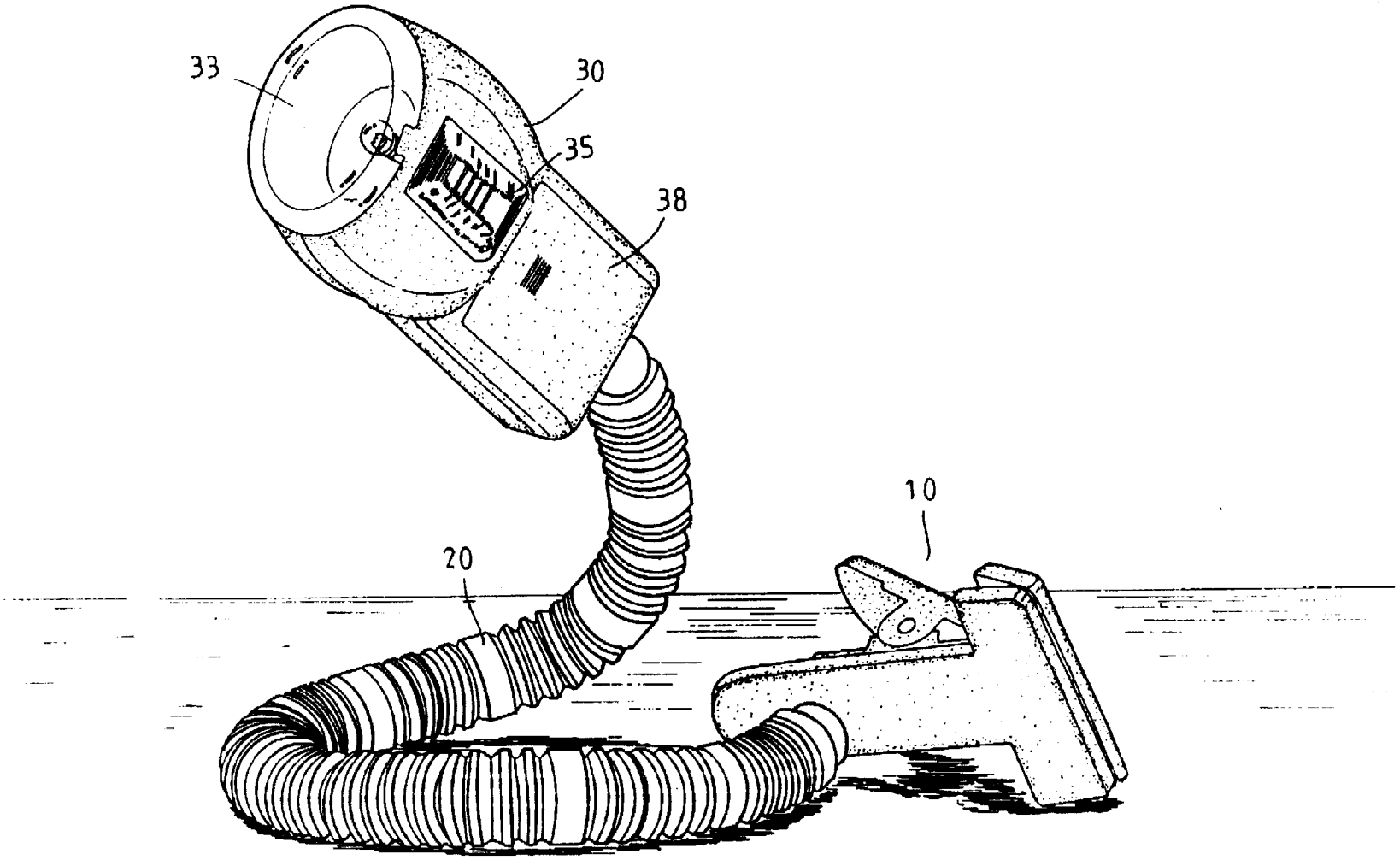
FIG. 5 is a perspective exploded view of FIG. 1.

Referring to FIGS. 1 and 5, a movable lamp device has a clamp device 10, a lamp casing 30, and a flexible tube 20 connecting the clamp device 10 and the lamp casing 30. The clamp device 10 has a first clamp 11 and a second clamp 12 disposed under the first clamp 11. The first clamp 11 and the second clamp 12 are fastened pivotally. A threaded through hole 113 is formed on the first clamp 11. Two lower lobes 114 are disposed on two opposite sides of the first clamp 11. An upper clamp portion 111 is disposed in a front of the first clamp 11. Two lower clips 112 are disposed beneath the upper clamp portion 111 of the first clamp 11. Two upper lobes 123 are disposed on two opposite sides of the second clamp 12. A lower clamp portion 121 is disposed in a front of the second clamp 12. Two upper clips 122 are disposed on the lower clamp portion 121 of the second clamp 12. A torsion spring 13 is disposed between two upper lobes 123. A pin 14 passes through the lower lobes 114, the torsion spring 13 and the upper lobes 123. The lamp casing 30 has a first half housing 31 and a second half housing 32 coupling with the first half housing 31. A main lamp 33 is disposed in a front of the lamp casing 30. A flash lamp 35 and a cell chamber 37 are disposed on a first side of the lamp casing 30. A hook device 34 is disposed on a second side of the lamp casing 30. A cell cover 37 covers the cell chamber 37. A switch 36 is disposed on a top portion of the lamp casing 30. A threaded recess hole 39 is formed in a rear portion of the lamp casing 30. A first threaded post 21 is disposed on a first end of the flexible tube 20. A second threaded post 22 is disposed on a second end of the flexible tube 20. The first threaded post 21 is inserted in the threaded through hole 113. The second threaded post 22 is inserted in the threaded recess hole 39.

Figure 2:
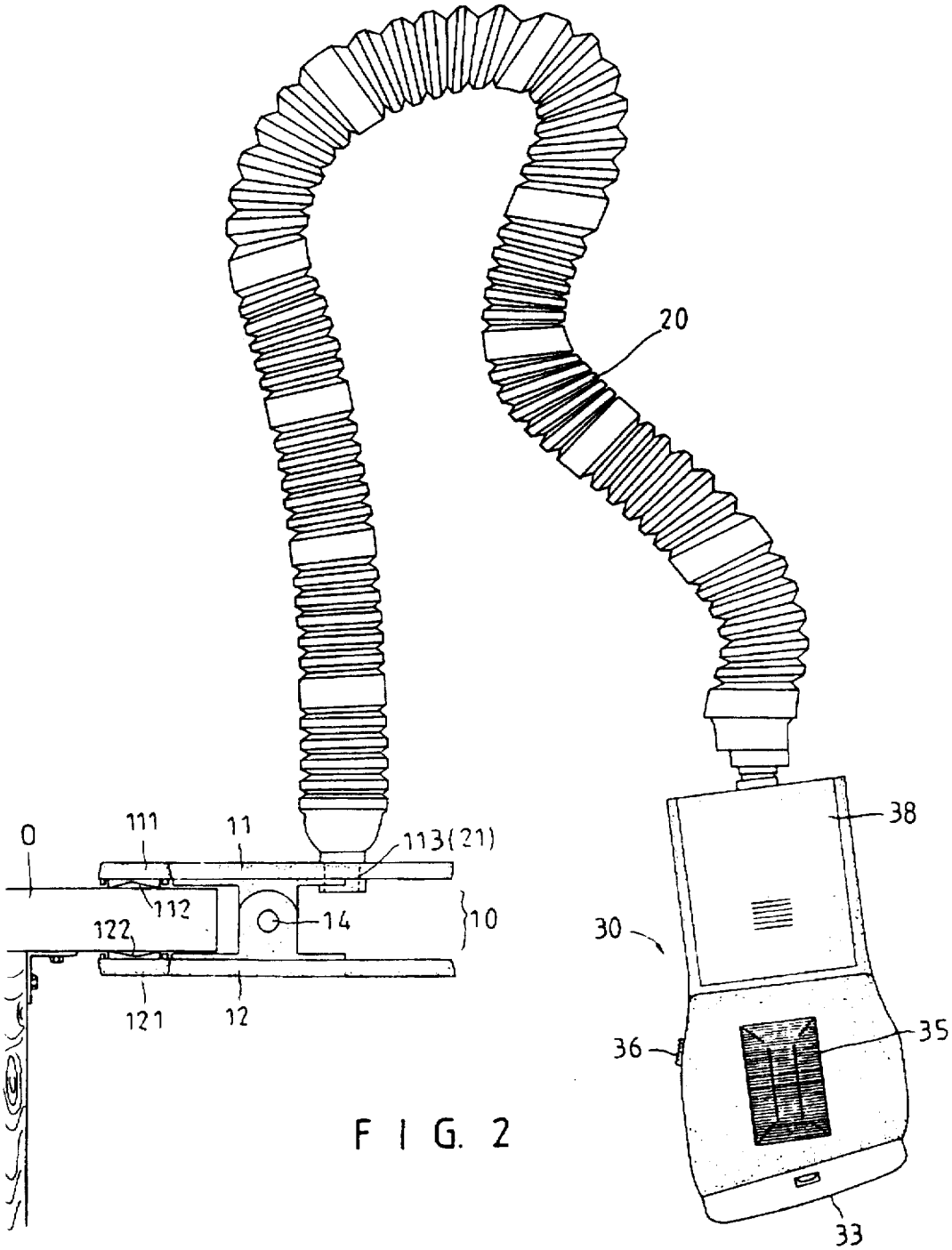
FIG. 2 is a side elevational view illustrating a movable lamp device positioned on a table.

Referring to FIG. 2, the clamp device 10 clamps a portion of a table O. The lamp casing 30 can be rotated to a predetermined direction.

Figure 3:
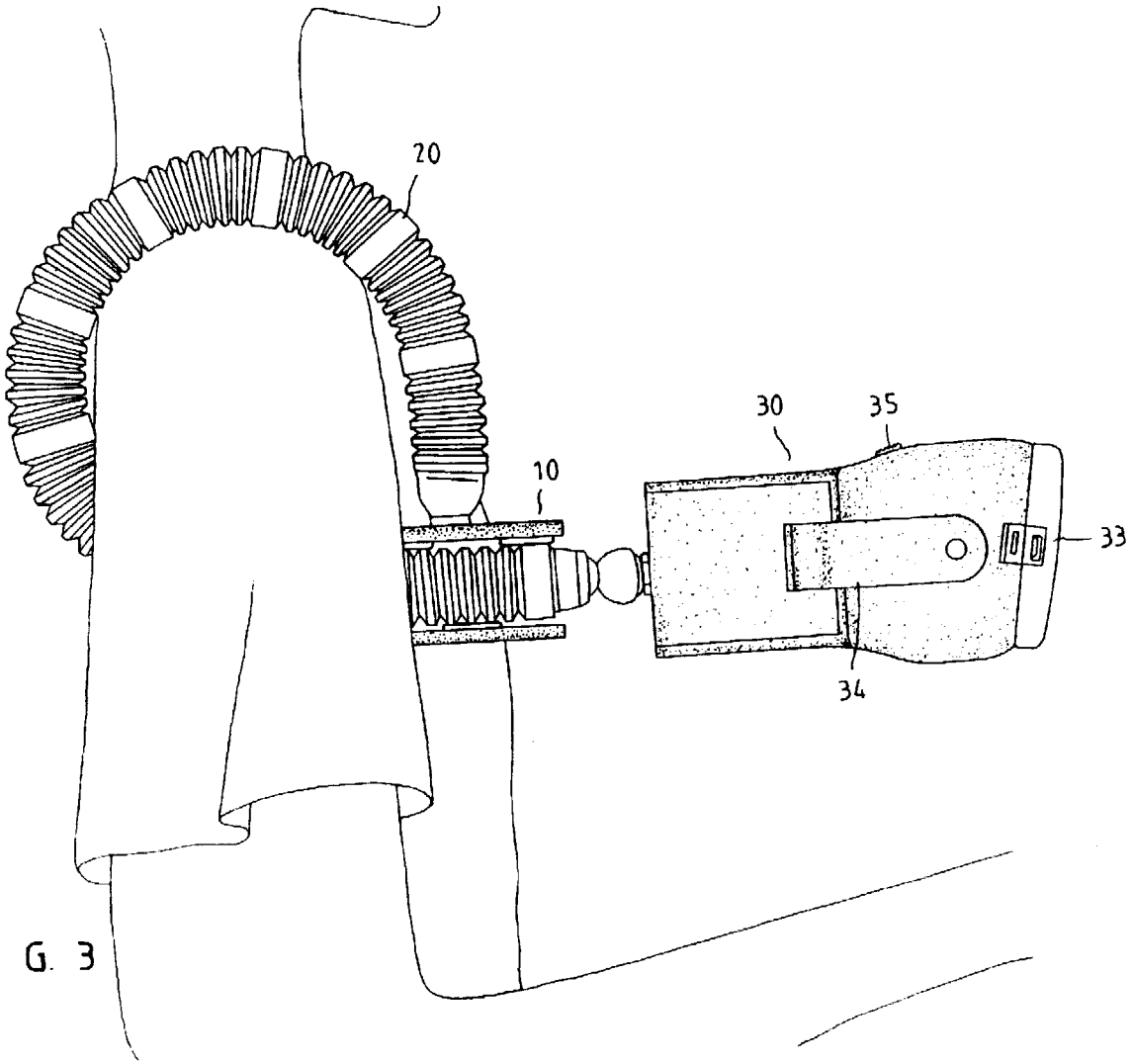
FIG. 3 is a side elevational view illustrating a movable lamp device wound on an arm of a user.

Referring to FIG. 3, the flexible tube 20 can surround the arm of the user.

Figure 4:
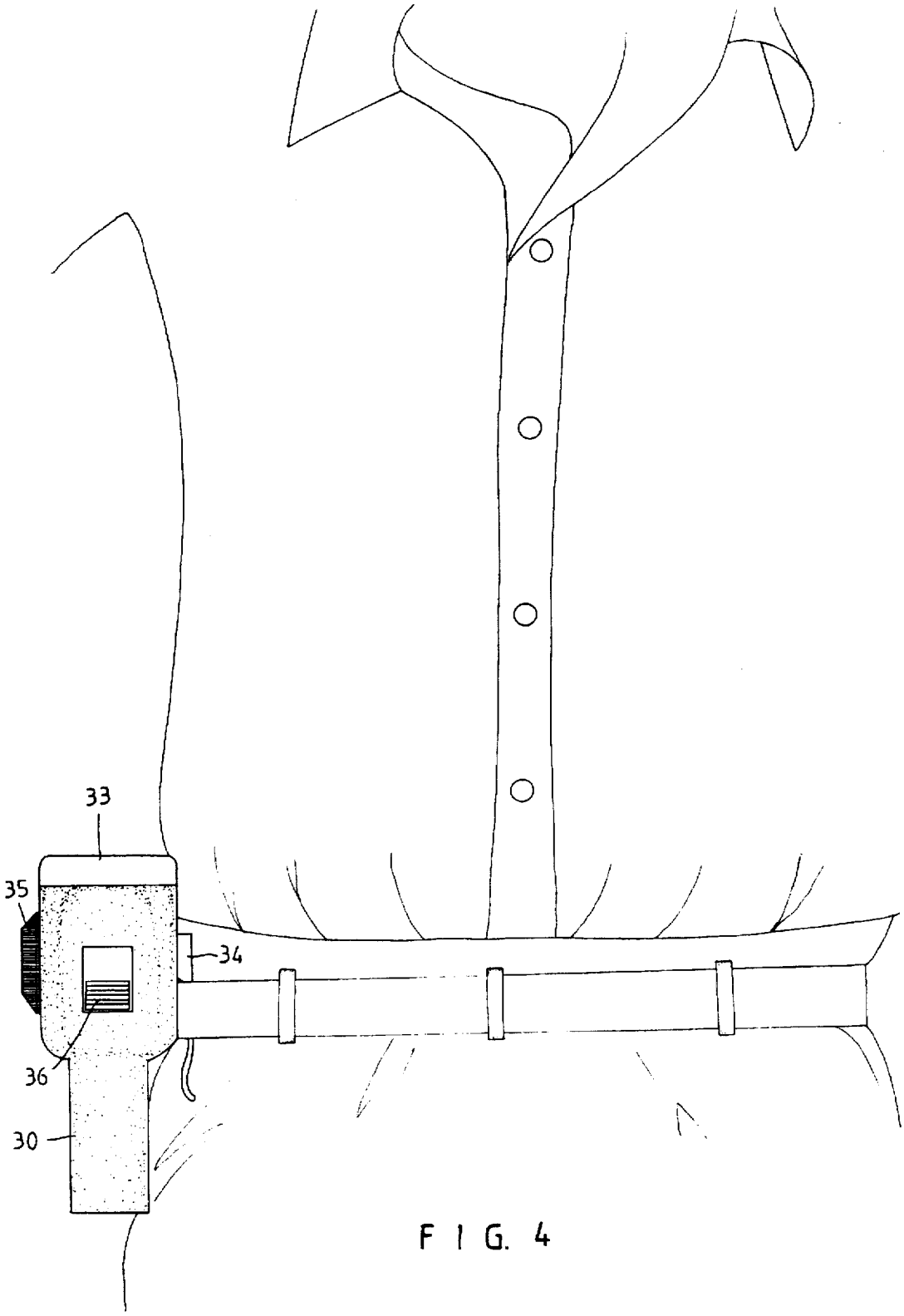
FIG. 4 is a side elevational view illustrating a movable lamp device positioned on a belt of a user.

Referring to FIG. 4, the lamp casing 30 can be positioned on the belt of the user via the hook device 34.

The invention is not limited to the above embodiment but various modification thereof may be made. Further, various changes in form and detail may be made without departing from the scope of the invention.

I claim:

1. A movable lamp device comprising:

a clamp device, a lamp casing, and a flexible tube connecting said clamp device and said lamp casing;

said clamp device having a first clamp and a second clamp disposed under said first clamp;

said first clamp and said second clamp fastened pivotally to each other;

a threaded through hole formed on said first clamp;

two lower lobes disposed on two opposite sides of said first clamp;

an upper clamp portion disposed in a front of said first clamp;

two lower clips disposed beneath said upper clamp portion of said first clamp;

two upper lobes disposed on two opposite sides of said second clamp;

a lower clamp portion disposed in a front of said second clamp;

two upper clips disposed on said lower clamp portion of said second clamp;

a torsion spring disposed between two upper lobes;

a pin passing through said lower lobes, said torsion spring and said upper lobes;

said lamp casing having a first half housing and a second half housing coupling with said first half housing;

a main lamp disposed in a front of said lamp casing;

a flash lamp and a cell chamber disposed on a first side of said lamp casing;

a hook device disposed on a second side of said lamp casing;

a cell cover covering said cell chamber;

a switch disposed on a top portion of said lamp casing;

a threaded recess hole formed in a rear portion of said lamp casing;

a first threaded post disposed on a first end of said flexible tube;

a second threaded post disposed on a second end of said flexible tube;

said first threaded post inserted in said threaded through hole; and said second threaded post inserted in said threaded recess hole.

* * * * *